US005952602A

United States Patent [19]

Gussalli Beretta

[11] Patent Number: 5,952,602

[45] Date of Patent: Sep. 14, 1999

[54] PRECISION DEVICE FOR HAND GUNS

[75] Inventor: Ugo Gussalli Beretta, Brescia, Italy

[73] Assignee: Fabbrica D'Armi P. Beretta S.p.A., Gardone V.T., Italy

[21] Appl. No.: 08/977,024

[22] Filed: Nov. 24, 1997

[30] Foreign Application Priority Data

Nov. 28, 1996 [IT] Italy ..... BS96A0091

[51] Int. Cl.[6] ..... F41G 1/02

[52] U.S. Cl. ..... 89/196; 89/163; 42/100

[58] Field of Search ..... 89/163, 196; 42/7, 42/50, 100

[56] References Cited

U.S. PATENT DOCUMENTS

| | | | |
|---|---|---|---|
| 687,448 | 11/1901 | Burgess | 42/7 |
| 1,348,284 | 8/1920 | Loomis | 89/196 |
| 2,898,693 | 8/1959 | Ruger | 89/196 |
| 3,435,727 | 4/1969 | Pachmayr et al. | 89/163 |
| 4,896,581 | 1/1990 | Cole | 89/196 |
| 5,501,135 | 3/1996 | Beretta | 89/196 |
| 5,654,519 | 8/1997 | Albrecht et al. | 89/163 |

FOREIGN PATENT DOCUMENTS

| | | | |
|---|---|---|---|
| 0 697 578 B1 | 2/1995 | European Pat. Off. . | |
| 437959 | 12/1926 | Germany | 89/196 |

*Primary Examiner*—Stephen M. Johnson
*Attorney, Agent, or Firm*—McGlew and Tuttle, P.C.

[57] ABSTRACT

A precision device for semiautomatic handguns, of the type that includes a single block barrel and recoil obturator carriage (11,12), where the barrel is susceptible to axial movement relative to the obturator carriage. On a cylindrical section (16) of the barrel, an alignment bush (17) is mounted, with a biconical external surface that has a first conical part (17') designed to fit in a conical hole (13) in the obturator carriage; and a second conical part (17"), of the opposite conical shape, designed to protrude forwards from the obturator carriage and be used with a blocking nut (18).

2 Claims, 1 Drawing Sheet

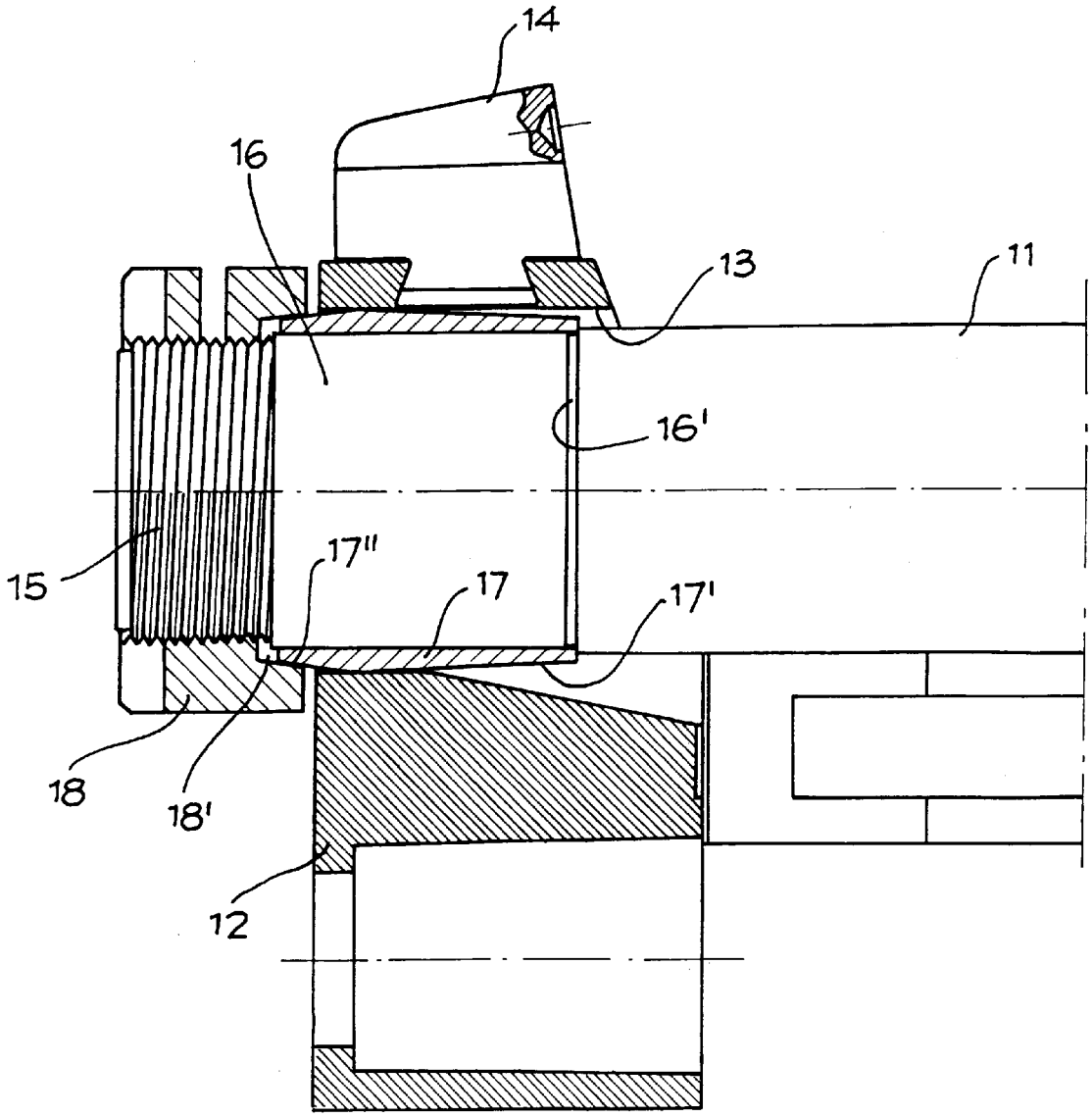
14
16
13
11
16'
15
17''
17
17'
18
18'
12

PRECISION DEVICE FOR HAND GUNS

FIELD OF THE INVENTION

This invention regards the improved precision of hand guns and is particularly applicable to semi-automatic firearms of various calibres, having a single block barrel and carriage with recoil obturator where the barrel is liable to move axially with respect to the obturator carriage.

BACKGROUND OF THE INVENTION

In these arms, the first cartridge is usually loaded in the firing chamber by pulling back the obturator carriage manually against the resistance of a return spring or other elasticated means of the loader. Then, when released, the obturator carriage moves forward to push the cartridge into the chamber and close the barrel-obturator carriage. Each successive cartridge enters the chamber similarly, due to the action of the compressed gases that are caused by the cartridge which has been fired. This action causes the backward movement of the obturator carriage, a barrel recoil which is shorter than that of the obturator carriage and the extraction of the used cartridge case.

On the front part of the obturator carriage there is usually a sight to help the operator get a better aim of the target. The barrel is a separate element and is guided by a certain clearance on the obturator carriage; therefore, a poor alignment between the barrel and the obturator carriage when they are in the firing position will cause a reduced precision in the arm, since the barrel is free to move up or down, or to right or left.

To rectify this, a variety of precision devices for firearms have been proposed, one of which described in U.S. Pat. No. 869,581. This well-known device consists of a bush, screwed on to the front end of the barrel and having a conical external surface, which is designed to fit a conical hole made in the front part of the obturator carriage.

However, in this action, the centring and the alignment stop between barrel and obturator carriage are entrusted exclusively to the external conical surface of the bush and the internal surface of the hole in the obturator carriage, given that there is no positive stop or block for the barrel against the upper surfaces of the oburator carriage. Furthermore, the conical bush, continually stressed by use of the gun, is subject to surface wear and has the tendency to come unscrewed. These are conditions which over time cause modifications in the action and the precision of the bush, with a consequent loss of accuracy.

The same applicant has also proposed a perfected precision device, which is the subject of a patent request in Italy, corresponding to the publication of European Patent N.O. 697 578.

This precision device is characterized by the fact that on the front part of the barrel, externally, there is a threaded end part and following this, towards the back of the barrel, there is a cylindrical section on which is mounted a conical alignment bush. The latter is designed to fit axially with the aforementioned conical hole in the obturator carriage, and on this threaded section are screwed the means for axial blocking of the bush, which include a regulating ring that will rest against both the alignment bush and the obturator carriage and a threaded nut for blocking the said regulating ring.

However, in this design, a certain unreliability has been noted in blockage of the alignment bush, because of the tendency of the ring to come unscrewed, and, furthermore, in order to compensate for wear of the bush it is necessary to move the latter axially, by adjusting the regulating ring and the blocking nut, as necessary.

SUMMARY AND OBJECTS OF THE INVENTION

The aim of this invention is to propose a newly designed precision device, which will guarantee a more stable blockage of the alignment bush, a consequent significant reduction in the coupling clearance, effectively prevent unscrewing, and, above all, reduce the number of device components to a minimum, essentially only two.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The single FIGURE shows a fragmentary view in cross-section of the precision device applied to the barrel-obturator carriage block of a firearm.

DETAILED DESCRIPTION OF THE PREFERRED EMBODIMENT

The barrel is indicated by 11 and the obturator carriage by 12.

The barrel 11 passes through, and can run along longitudinally, a hole 13, which is situated in the front part of the obturator carriage 12. On the front part of this obturator carriage 12 there is a sight 14.

The hole 13 in the obturator carriage 12 is conical and narrows from front to back. On the front part of the barrel 11, externally, there is a threaded end piece 15, next to which, towards the back of the barrel 11, there is a cylindrical section 16. The cylindrical section 16 has a diameter slightly greater than the threaded end piece 15, but less than the remaining part of the barrel, so that there is, effectively, a circular blocking step 16' between the cylindrical section 16 and the remaining part of the barrel 11.

On the cylindrical section 16 of the barrel 11 an alignment bush 17 with a biconical external surface is mounted, and on the threaded part 15 of the barrel 11 there is a blocking nut 18.

The aligning bush 17 has a forward conical part 17' which faces towards the rear and has a conical shape which corresponds to that of the conical hole 13 in the obturator carriage. The second conical part 17" faces forwards and has a conical shape which is the reverse of the other, that is, it tapers towards the front.

The blocking nut 18, in its turn, has, for part of its length, a conical cavity 18' which has a dimension and conical shape that corresponds to the second conical part 17" of the alignment bush 17.

This bush 17 is precision mounted on the cylindrical section 16 of the barrel 11 and the edge of its first conical part 17' rests against the blocking step 16', where it is held by the blocking nut 18.

The first conical part 17' of the bush 17 is designed to fit the conical hole 13 in the obturator carriage 12 when the barrel 11 and the carriage 12 are moved completely forwards, as shown in the drawing. Furthermore, the bush 17 should be of a length such that the second conical part 17" protrudes beyond the obturator carriage 12 when this is completely advanced and fitted to the first conical part 17' of the said bush 17.

In this way, the second conical part 17" can fit with the conical cavity 18' of the blocking nut 18, so that by screwing home the latter the bush will be blocked against the blocking step 16', and also on the cylindrical section 16 of the barrel 11 due to mechanical deformation of the said second section of the bush 17 caused by the action of the nut. This gives the bush 17 a secure hold during operation, a significant reduction in coupling clearance and an effective means of preventing the nut from unscrewing. At the same time, there is still room for relative axial movement between barrel 11 and obturator carriage 12 when the gun is in use, allowing the cartridge to be loaded in the barrel, the extraction of the used case, and guaranteeing the correct alignment of the barrel when the firearm is closed, ready for firing.

Finally, it should be noted that to compensate for wear of the alignment bush 17 a series of calibrated bushes can be prepared and, when needed, one of these can be used to substitute the one that is worn.

What is claimed is:

1. A precision device for semi-automatic handguns, with a single block barrel and recoil obturator carriage, the barrel being susceptible to axial movement with regard to the obturator carriage, the device comprising:

a conical hole provided in the obturator carriage, the barrel extending into said conical hole, said conical hole having a diameter that decreases in a direction toward a rear of the obturator carriage;

a threaded section provided at an external end of the barrel;

a cylindrical section of the barrel provided adjacent to said threaded section and in a direction toward a rear of the barrel with respect to said threaded section;

a conical alignment bush on said cylindrical section, said conical alignment bush being provided to fit axially in said conical hole in the obturator carriage, said alignment bush having a biconical external surface, with a first conical part corresponding to, and designed to fit, said conical hole in the obturator carriage and a second conical part with a reverse conical shape to that of said first conical part, designed to protrude forwards from the obturator carriage when said first conical part is fitted into said conical hole; and a nut blocking device for blocking said alignment bush on the cylindrical section of the barrel, said nut blocking device being screwed on said threaded section of the barrel, said nut blocking device having a conical cavity that corresponds to said second conical part, interacting with said second conical part to block said conical alignment bush tightly on said cylindrical section, when said nut blocking device is screwed onto the said threaded section.

2. The precision device according to claim 1, where said conical alignment bush is held axially between said nut and a shoulder ring provided at an edge of aids cylindrical section furthest from said threaded section.

* * * * *